US007242376B2

(12) United States Patent
Yamashita et al.

(10) Patent No.: US 7,242,376 B2
(45) Date of Patent: Jul. 10, 2007

(54) DISPLAY DEVICE

(75) Inventors: Junichi Yamashita, Tokyo (JP); Katsuhide Uchino, Kanagawa (JP); Teturo Yamamoto, Kanagawa (JP)

(73) Assignee: Sony Corporation, Tokyo (JP)

( * ) Notice: Subject to any disclaimer, the term of this patent is extended or adjusted under 35 U.S.C. 154(b) by 628 days.

(21) Appl. No.: 10/826,335

(22) Filed: Apr. 19, 2004

(65) Prior Publication Data

US 2004/0263501 A1 Dec. 30, 2004

(30) Foreign Application Priority Data

Apr. 30, 2003 (JP) ..... 2003-125979

(51) Int. Cl.
*G09G 3/30* (2006.01)

(52) U.S. Cl. ..... 345/76; 327/91; 349/42

(58) Field of Classification Search ..... 345/76–81, 345/84; 349/42; 313/500; 315/169.1; 257/59; 327/91

See application file for complete search history.

(56) References Cited

U.S. PATENT DOCUMENTS 6,611,107 B2 * 8/2003 Mikami et al. ..... 315/169.1
6,917,350 B2 * 7/2005 Pae et al. ..... 345/55

* cited by examiner

*Primary Examiner*—Richard Hjerpe
*Assistant Examiner*—Abbas Abdulselam
(74) *Attorney, Agent, or Firm*—Oblon, Spivak, McClelland, Maier & Neustadt, P.C.

(57) ABSTRACT

A display device able to hold a drain potential of an output transistor functioning as a constant current source constant even in a sampling period of another circuit, able to suppress a change due to leakage of a gate potential of the output transistor, able to obtain a uniform current source free from variation in current value of an output stage, and able to display a high quality image without occurrence of uneven luminance toward a scanning end part, wherein for example a current sample and hold circuit finishing a sampling and holding operation during a period where the sampling and holding operation of its own stage is ended and another stage is performing a sampling and holding operation is configured so as to carry a constant current corresponding to a sampled current by a thin film transistor through a node by operating a leakage elimination circuit.

4 Claims, 15 Drawing Sheets

FIG. 4A SHSW
FIG. 4B SHL32-1
FIG. 4C SHL31-1
FIG. 4D SHL32-2
FIG. 4E SHL31-2
....
FIG. 4F SHL32-n
FIG. 4G SHL31-n
FIG. 4H Vd331
FIG. 4I Vd332
....
FIG. 4J Vd33n
FIG. 4K VC111
FIG. 4L VC112
....
FIG. 4M VC11n

FIG. 10A HSW
FIG. 10B SHL122-1
FIG. 10C SHL121-1
FIG. 10D SHL122-2
FIG. 10E SHL121-2
FIG. 10F SHL122-n
FIG. 10G SHL121-n
FIG. 10H SHL123-1
FIG. 10I SHL123-n
FIG. 10J Vd1211
FIG. 10K Vd1212
...
FIG. 10L Vd121n
FIG. 10M VC1211
FIG. 10N VC1212
...
FIG. 10O VC121n

DISPLAY DEVICE

BACKGROUND OF THE INVENTION

1. Field of the Invention

The present invention particularly relates to an organic electroluminescence (EL) display or other image display device comprising pixel circuits having electro-optical elements controlled in luminance by a current value arranged in a matrix, in particular a so-called active matrix type image display device wherein the value of the current flowing through an electro-optical element is controlled by an insulating gate type field effect transistor provided inside each pixel circuit.

2. Description of the Related Art

In an image display device, for example, a liquid crystal display, an image is displayed by arranging a large number of pixels in a matrix and controlling a light intensity for every pixel in accordance with image information to be displayed. The same is true for an organic EL display etc., but an organic EL display is a so-called self light emitting type display which has light emitting elements in the pixel circuits and has the advantages that the viewability is high in comparison with a liquid crystal display, no backlight is required, a response speed is high, etc. Further, it greatly differs from a liquid crystal display etc. in the point that the luminance of each light emitting element is controlled by the value of the current flowing through it to give tones of the emitted colors, that is, the light emitting elements are current controlled types.

An organic EL display, in the same way as a liquid crystal display, may be driven by the simple matrix system and the active matrix system, but while the former is simple in structure, but has problems such as the difficulty of realization of a large scale and high definition display. For this reason, there has been active development of the active matrix system controlling the current flowing through the light emitting element inside each pixel circuit by an active element provided inside the pixel circuit, generally, a thin film transistor (TFT).

FIG. 1 is a block diagram of the configuration of an organic EL display device employing the current driving system. This display device 1 has, as shown in FIG. 1, a pixel array 2 comprised of pixel circuits (PXLC) 2*a* arrayed in an m×n matrix, a horizontal selector (HSEL) 3, a write scanner (WSCN) 4, a drive scanner (DSCN) 5, data lines DTL1 to DTLn to which data signals selected by the horizontal selector 3 and in accordance with the luminance information are supplied, scanning lines WSL1 to WSLm selectively driven by the write scanner 4, and drive lines DSL1 to DSLm selectively driven by the drive scanner 5.

FIG. 2 is a circuit diagram of an example of the configuration of a pixel circuit 2*a* of FIG. 1.

The pixel circuit 2*a* of FIG. 2 has p-channel thin film field effect transistors (hereinafter referred to as TFT) 11 to 14, a capacitor C11, and a light emitting element constituted by an organic EL element (OLED) 15. Further, in FIG. 2, DTL shows a data line through which the input signal is propagated as current. An organic EL element often has a rectification property, so is sometimes referred to as an organic light emitting diode (OLED). In FIG. 2 and the other figures, use is made of the symbol of a diode as the light emitting element, but in the following explanation, a rectification property is not always required from the OLED. In FIG. 2, a source of the TFT 11 is connected to a power supply potential VCC (supply line of power supply voltage VCC), while a cathode of the light emitting element 15 is connected to a ground potential GND. The pixel circuit 2*a* of FIG. 2 operates as follows.

At the time of writing an input signal (current signal) SI, the TFT 13 and the TFT 14 are held in a conductive state in the state holding the TFT 12 in a nonconductive state. Due to this, a current in accordance with the signal current flows through tthe drive transistor constituted by the TFT 11. At this time, a gate and a drain of the TFT 11 are electrically connected by the TFT 13 in the conductive state, and the TFT 11 is driven in a saturation region. Accordingly, the gate voltage corresponding to the input current is written based on the following equation 1 and held in the pixel capacitance constituted by the capacitor C11. Thereafter, the TFT 14 is held in the nonconductive state, and the TFT 12 is held in the conductive state. Due to this, a current in accordance with the input signal current flows through the TFT 12 and the light emitting element 15, whereby the light emitting element 15 emits light with a luminance in accordance with the current value. As described above, the operation for turning on the TFT 14 to transfer the luminance information given to the data line to the inside of a pixel will be referred to as "writing" below.

In this pixel circuit 2*a*, variation in a threshold value Vth and mobility μ of the drive transistor 11 are corrected.

$$Ids=\tfrac{1}{2}\cdot\mu(W/L)Cox(Vgs-|Vth|)^2 \quad (1)$$

Here, μ indicates the mobility of the carrier, Cox shows a gate capacitance per unit area, W shows a gate width, L shows a gate length, Vgs shows a gate-source voltage of the TFT 11, and Vth indicates the threshold value Vth of the TFT 11.

In this system, a video signal is input as the current value Iin to the horizontal selector 3 of the panel. The input current signal is sampled and held at the horizontal selector 3. After all stages are sampled and held, the current value is simultaneously output to the data lines DTL to which the pixels are connected.

FIG. 3 is a circuit diagram of the configuration of principal parts of the horizontal selector 3. The horizontal selector 3 has, as shown in FIG. 3, current sample and hold circuits 31-1, 31-2, . . . , and 31-n provided corresponding to the data lines DTL1, DTL2, . . . , and DTLn laid for every column of the matrix array of the pixel circuits and supplied with data signals in accordance with the luminance information and horizontal switches (HSWs) 32-1, 32-2, . . . , and 32-n formed by n-channel TFTs.

The current sample and hold circuit 31-1 has, as shown in FIG. 3, a TFT 33-1, TFT 34-1, TFT 35-1, a capacitor C31-1, and nodes ND31-1 and ND32-1. In the same way as the above, the current sample and hold circuit 31-1 has, as shown in FIG. 3, a TFT 33-2, TFT 34-2, TFT 35-2, a capacitor C31-2, and nodes ND31-2 and ND32-2. Then, although not illustrated, the current sample and hold circuit 31-n has a TFT 33-n, TFT 34-n, TFT 35-n, a capacitor C31-n, and nodes ND31-n and ND32-n.

The sample and hold operation of this horizontal selector 3 will be explained in relation to FIGS. 4A to 4M. Note that the SHSW of FIG. 4A shows a switch signal of the horizontal switch. Further, FIG. 4H shows a drain potential Vd331 of the first column TFT 33-1, FIG. 4I shows a drain potential Vd332 of the second column TFT 33-2, FIG. 4J shows a drain potential Vd33*n* of the n-th column TFT 33-n, FIG. 4K shows a potential VC111 of the first column capacitor C11-1, FIG. 4L shows a potential VC112 of the second column capacitor C11-2, and FIG. 4M shows a potential VC11*n* of the n-th column capacitor C11-n.

As shown in FIG. 4A, in a state where the switch signal SHSW is set at the low level and all horizontal switches HSW are turned off, as shown in FIGS. 4B and 4C, the sample and hold lines SHL31-1 and 32-1 to which the TFT 34-1 and TFT 35-1 of the first column current sample and hold circuit 31-1 are connected are set at the high level to place the TFT 34-1 and TFT 35-1 in the conductive state (turn them on). At this time, the input signal current Iin flows in the current sample and hold circuit 31-1. At this time, the TFT 33-1 is connected at a gate and a drain via the TFT 34-1, so operates in the saturation region. The gate voltage thereof is determined based on above equation 1 and, as shown in FIG. 4K, it is held in the capacitor C31-1. After the predetermined gate voltage is written into the capacitor C31-1, the sample and hold line SHL31-1 is set at the low level and the TFT 34-1 is placed in the nonconductive state. Thereafter, the sample and hold line SHL32-1 is placed in the low level, and the TFT 35-1 is placed in the nonconductive state.

Next, in the same way, as shown in FIGS. 4D and 4E, by making the sample and hold lines SHL31-2 and 32-2 to which the TFT 34-2 and TFT 35-2 of the second column current sample and hold circuit 31-2 are connected the high level, the TFT 34-2 and TFT 35-2 are placed in the conductive state (turned ON). At this time, the input signal current Iin flows through the current sample and hold circuit 31-2. At this time, the TFT 33-2 is connected at a gate and a drain via the TFT 34-2, so operates in the saturation region. The gate voltage thereof is determined based on the above equation 1 and, as shown in FIG. 4L, is held in the capacitor C31-2. After the predetermined gate voltage is written into the capacitor C31-2, the sample and hold line SHL31-2 is placed at the low level and the TFT 34-2 is placed at the nonconductive state, then the sample and hold line SHL32-2 is placed at the low level and the TFT 35-2 is placed at the nonconductive state. After this, the adjacent sample and hold circuits sequentially operate, and video signals Iin are point sequentially sampled and held in all circuits. Thereafter, as shown in FIG. 4A, all stages of the horizontal switch HSW are simultaneously turned ON, the TFT 33-1 to TFT 33-n act as constant current sources, and, as shown in FIG. 5, the sampled and held current values are output to the data lines DTL1 to DTLn.

In the above horizontal selector 3, however, there is the disadvantage that the drain potential of a TFT 33(-1 to -n) functioning as a constant current source, particularly the drain potential of a TFT 33 for which a sample and hold operation was previously carried out falls, therefore it can not be held constant. This problem will be explained in further detail next.

Here, the potential of each node at the time of sampling and holding of the first column current sample and hold circuit 31-1 will be investigated. In the current sample and hold circuit 31-1, as shown in FIG. 6A, the TFT 35-1 is held in the nonconductive state to sample and hold the input current Iin. During this period, the TFT 33-1 is continuously on, so the drain potential of the TFT 33-1 (potential of the ND31-1) loses its supply source and falls to the ground potential GND level. At this time, note the TFT 34-1. The TFT 34-1 is turned off, and the gate potential corresponding to the current Iin is held in the capacitor C31-1.

However, due to the potential of the node ND31-1 dropping to the ground potential GND level, the TFT 34-1, as shown in FIG. 6B, ends up being supplied with the drain-source voltage Vds, and a leakage current flows through the TFT 34-1. Due to the leakage current flowing out from the capacitor C31-1, the gate voltage of the TFT 33-1 is reduced. Due to this, the gate-source voltage Vgs of the TFT 33-1 ends up being reduced from that at the time of the sampling and holding. Even if the horizontal switch HSW turns on and becomes the saturation state thereafter, only a current having a value smaller than the current Iin ends up flowing. This leakage amount is proportional to a leakage time.

The sample and hold circuit operates point sequentially as mentioned above, therefore the time during which the gate potential is held in each capacitor differs between a scanning start part and a scanning end part. Namely, as shown in FIGS. 4K to 4M, the holding time becomes longer at the scanning start part in comparison with the end part. For this reason, the leakage time becomes longer and the drop in the gate voltage becomes larger at the scanning start part in comparison with the scanning end part. That is, even with a single colored raster display over the entire screen, as shown in FIG. 7, the luminance ends up with gradation toward the scanning end part. Particularly, the leakage current is high in a TFT for driving an organic EL etc., so this problem conspicuously appears.

This problem can occur at any time when sampling a current regardless of the fact the display is an organic EL. For example, when sampling the current point sequentially and outputting the results all together, for the same reason, the current value of the output ends up differing between the sampling start part and the end part.

SUMMARY OF THE INVENTION

An object of the present invention is to provide a display device able to hold a drain potential of an output transistor functioning as a constant current source constant even during a sampling period of another circuit, able to suppress a change due to leakage of the gate potential of the output transistor, able to obtain a uniform current source free from variation in the current value of output stages, and able to display a high quality image not suffering from uneven luminance toward the scanning end part.

To attain the above object, according to a first aspect of the present invention, there is provided a display device to which a video signal is supplied as a signal current, comprising a plurality of pixel circuits arrayed in a matrix; data lines laid for every column of the matrix array of the pixel circuits and supplied with a signal current in accordance with luminance information; and a horizontal selector having a plurality of sample and hold circuits provided corresponding to the data lines and sampling and holding the input video signal current and for sequentially operating the sample and hold circuits, point sequentially sampling and holding video signals at all sample and hold circuits, and outputting current values sampled and held in the plurality of sample and hold circuits to corresponding data lines, wherein each sample and hold circuit has a field effect transistor having a source connected to a predetermined potential, a first switch connected between a drain and a gate of the field effect transistor, a second switch connected between the drain of the field effect transistor and a supply line of the signal current, a capacitor connected between the gate of the field effect transistor and the predetermined potential, and a leakage elimination circuit for supplying a current corresponding to the sampled signal current to the drain of the field effect transistor during a period when the sample and hold operation is finished and another sample and hold circuit performs a sample and hold operation.

Preferably, the leakage elimination circuit comprises a diode connected transistor connected between a predetermined potential and the drain of the field effect transistor and a third switch connected in series.

According to a second aspect of the invention, there is provided a display device to which a video signal is supplied as a signal current, comprising a plurality of pixel circuits arrayed in a matrix; data lines laid for every column of the matrix array of the pixel circuits and supplied with a signal current in accordance with luminance information; and a horizontal selector having a plurality of sample and hold circuits provided corresponding to the data lines and sampling and holding the input video signal current and for sequentially operating the sample and hold circuits, point sequentially sampling and holding a video signal in all sample and hold circuits, and outputting current values sampled and held at the plurality of sample and hold circuits to corresponding data lines, wherein each sample and hold circuit has a first field effect transistor having a source connected to a predetermined potential, a second field effect transistor having a source connected to a drain of the first field effect transistor, a first switch connected between a drain and a gate of the second field effect transistor, a second switch connected between the drain of the second field effect transistor and a supply line of the signal current, a third switch connected between the drain and a gate of the first field effect transistor, a first capacitor connected between the gate of the first field effect transistor and a predetermined potential, a second capacitor connected between the gate of the second field effect transistor and a predetermined potential, and a leakage elimination circuit for supplying a current corresponding to the sampled signal current to the drain of the second field effect transistor during a period when the sample and hold operation is finished and another sample and hold circuit is performing a sample and hold operation.

Preferably, the leakage elimination circuit comprises a diode connected transistor connected between a predetermined potential and the drain of the second field effect transistor and a fourth switch connected in series.

According to the present invention, the first and second switches of for example the first column sample and hold circuit are placed in the conductive state (turned on). At this time, the input signal current flows in the sample and hold circuit. At this time, the field effect transistor is connected at the gate and the drain via the first switch and operates in the saturation region. The gate voltage thereof is determined based on equation 1 and held in the capacitor. After the predetermined gate voltage is written into the capacitor, for example the first switch is placed in the nonconductive state, then the second switch is placed in the nonconductive state. Next, in the same way as above, the first and second switches of the second column sample and hold circuit are placed in the conductive state (turned on). At this time, the input signal current flows in the second column sample and hold circuit. At this time, the field effect transistor is connected at the gate and the drain via the first switch and operates in the saturation region. The gate voltage thereof is determined based on equation 1 and held in the capacitor. After the predetermined gate voltage is written into the capacitor, for example the first switch is placed in the nonconductive state, then the second switch is placed in the nonconductive state.

Below, the adjacent sample and hold circuits sequentially operate, and video signal is point sequentially sampled and held in all circuits. During a period when the sampling and holding operation of the same stage is finished and another stage is performing a sampling and holding operation, for example, the sample and hold circuit finishing the sampling and holding operation brings the third switch to the conductive state. Then, in the diode connected transistor, a current Iin according to a constant current source including a field effect transistor flows. The input current is sampled and held in the constant current source here, therefore the current Iin flows through the diode connected transistor and the field effect transistor configuring the constant current source. At this time, a constant current corresponding to the sampled current Iin flows through the diode connected transistor. The transistor operates in the saturation region, therefore the gate voltage (drain voltage) of this transistor is determined in its operation point based on equation 1. This gate potential becomes equal to the drain potential of the field effect transistor. Here, by designing the size of the diode connected transistor so that the drain potential of the field effect transistor becomes equal to the gate voltage of the field effect transistor as much as possible, a voltage difference between the source and the drain of for example the transistor configuring the first switch can be suppressed. From the above description, even in the point sequential sampling of the current, it becomes possible to prevent the leakage amount from changing much at all between the scanning start and end part blocks, and a uniform output current can be obtained. Thereafter, the field effect transistors of all sample and hold circuits function as constant current sources, and the sampled and held current values are output in parallel to the data lines. By this, it becomes possible to display a high quality image without generating an uneven luminance toward the scanning end part.

BRIEF DESCRIPTION OF THE DRAWINGS

These and other objects and features of the present invention will become clearer from the following description of the preferred embodiments given with reference to the accompanying drawings, in which.

DESCRIPTION OF THE PREFERRED EMBODIMENTS

Below, preferred embodiments of the present invention will be described with reference to the accompanying drawings.

First Embodiment

Figure 1:
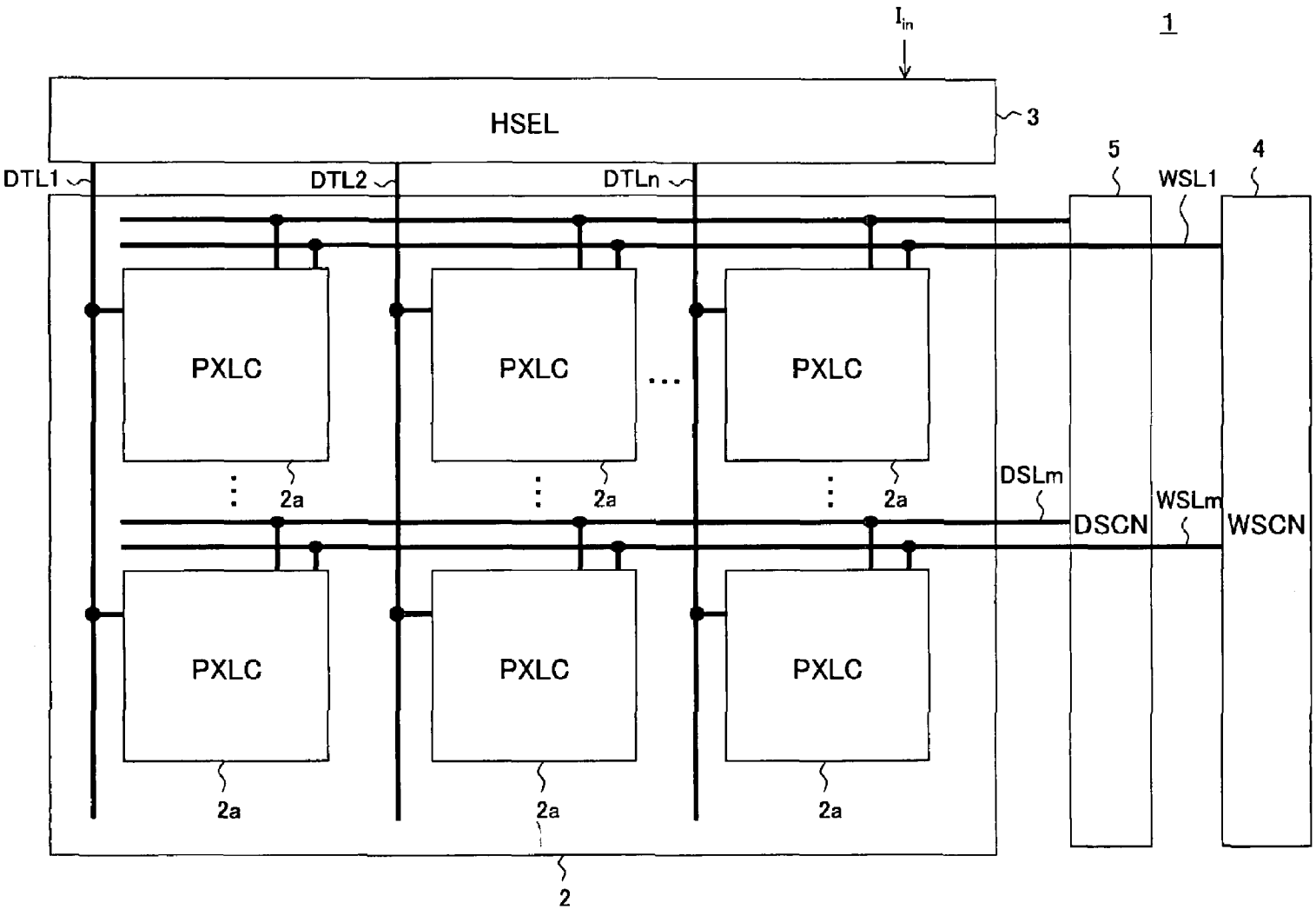
FIG. 1 is a block diagram of the configuration of a general organic EL display device.
Figure 2:
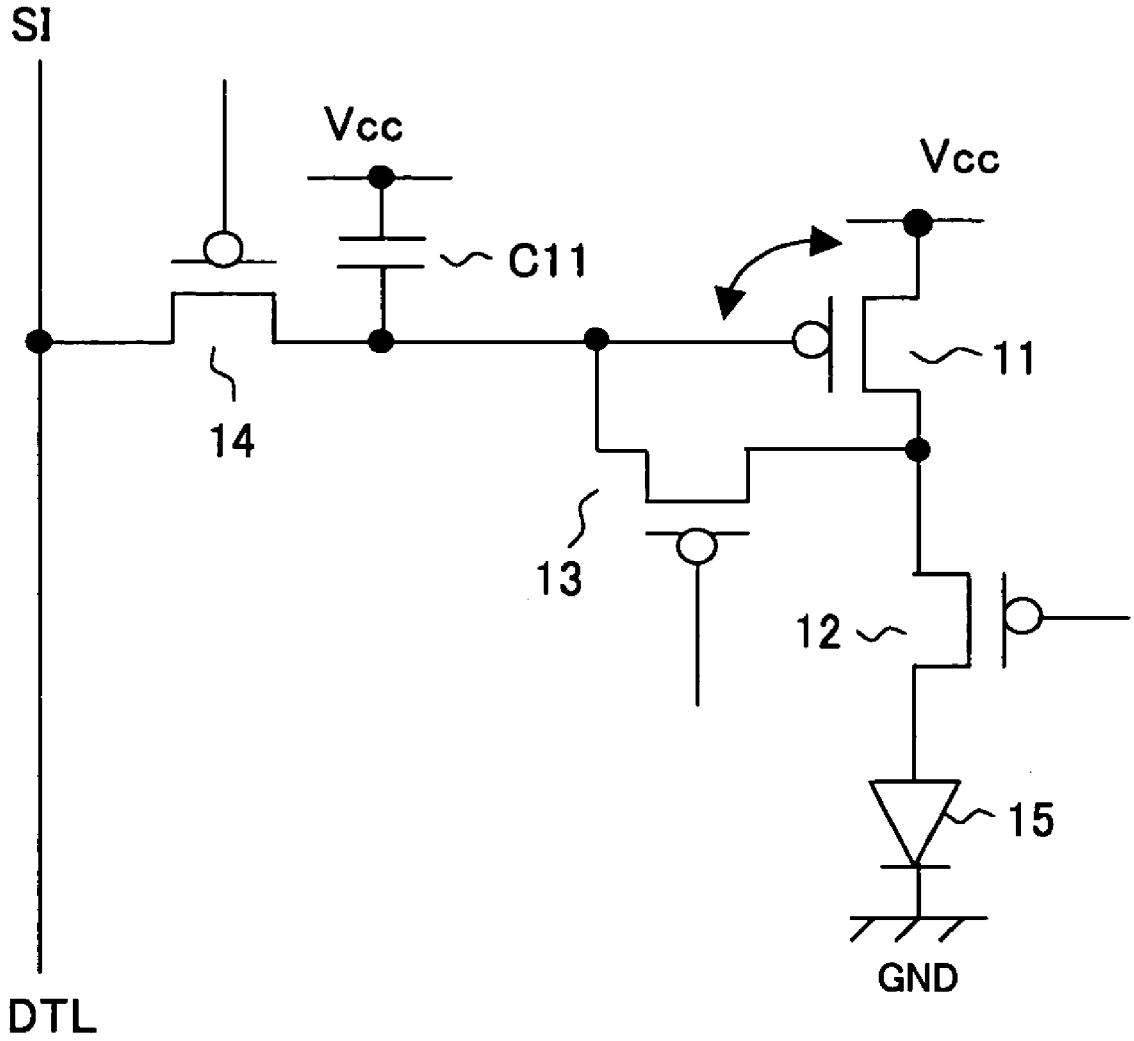
FIG. 2 is a circuit diagram of an example of the configuration of the pixel circuit of FIG. 1.
Figure 3:
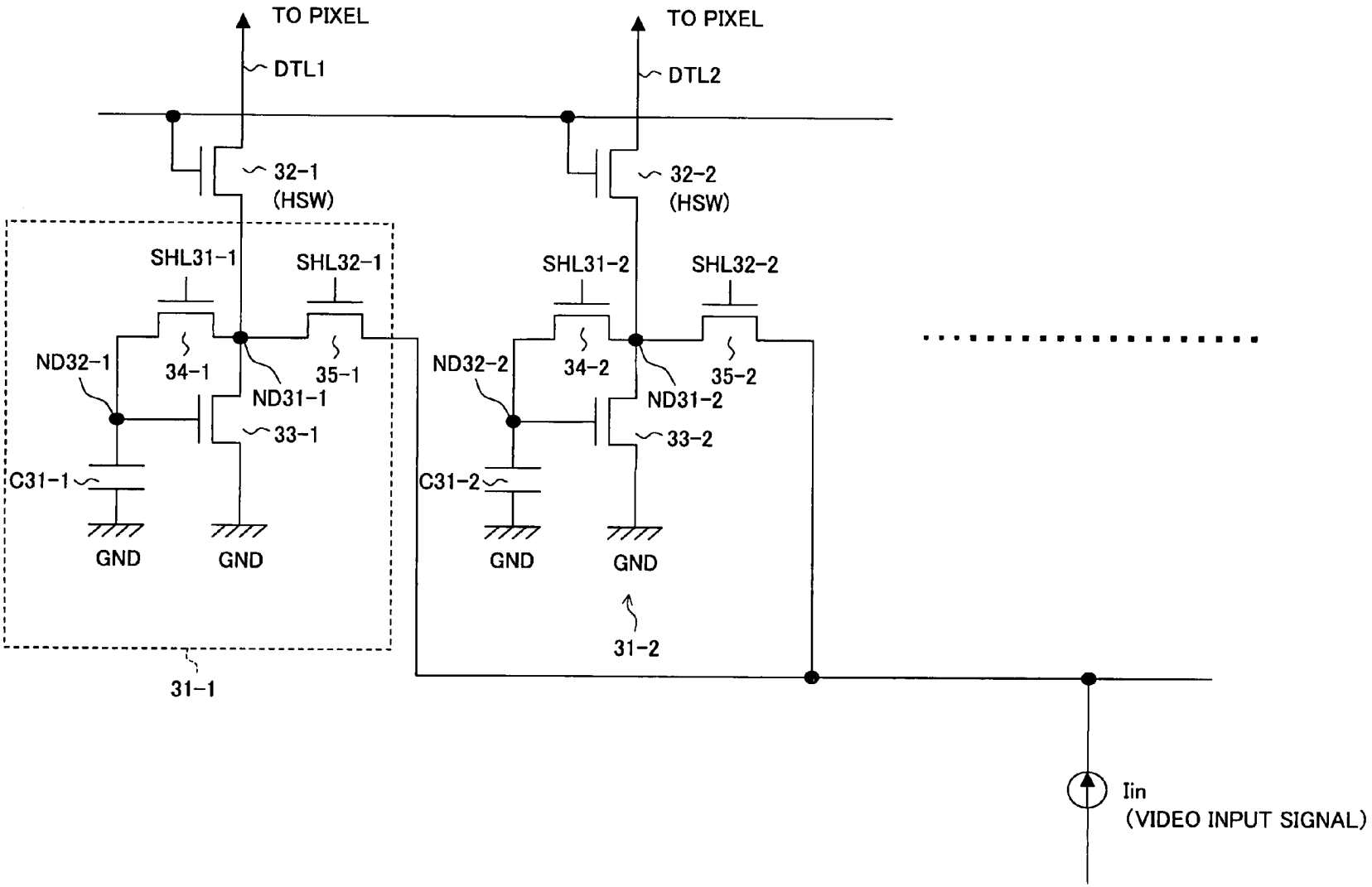
FIG. 3 is a circuit diagram of the concrete configuration of principal parts of a horizontal selector of FIG. 1.
Figure 4:
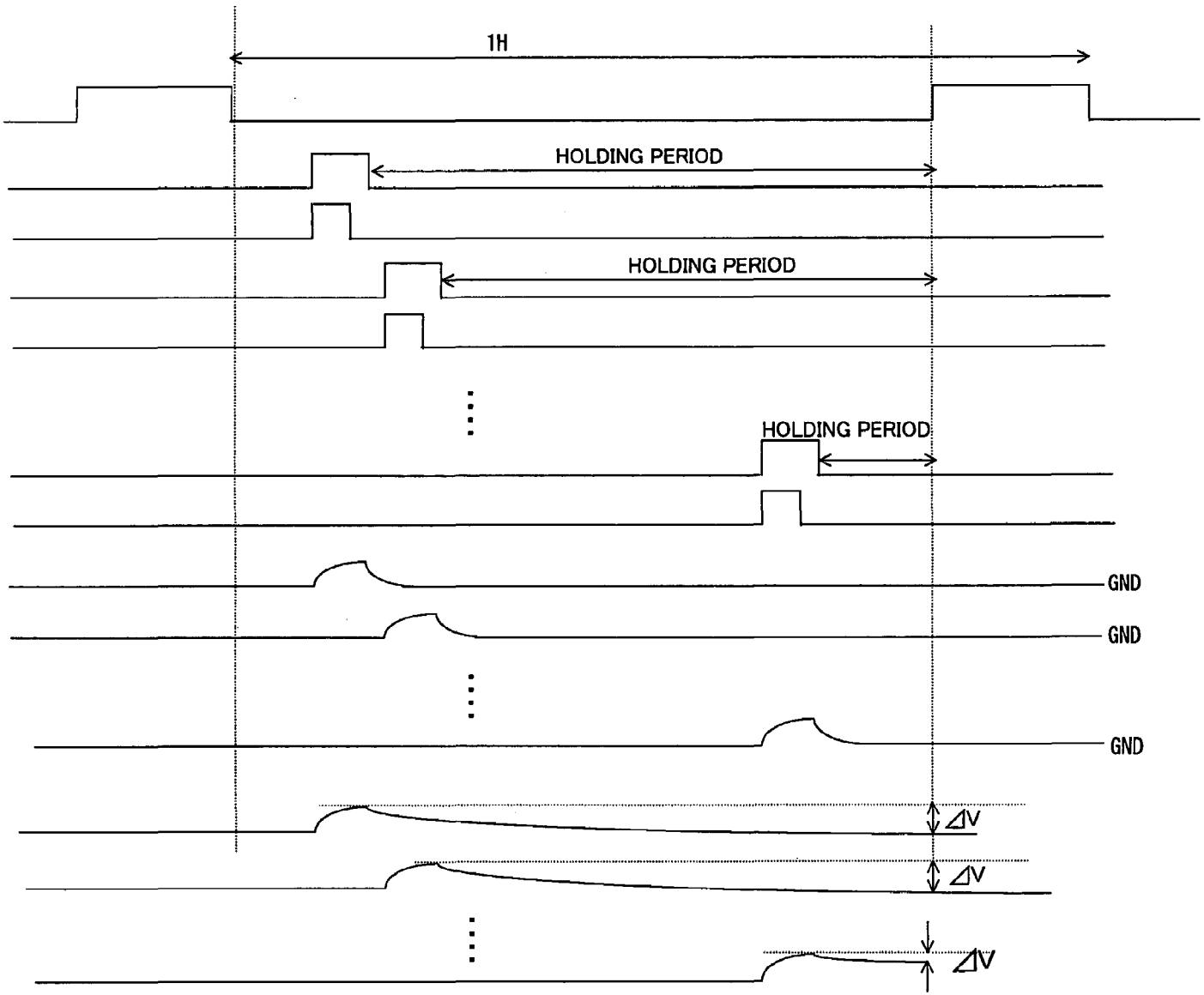
FIGS. 4A to 4M are timing charts for explaining the operation of the circuit of FIG. 3.
Figure 5:
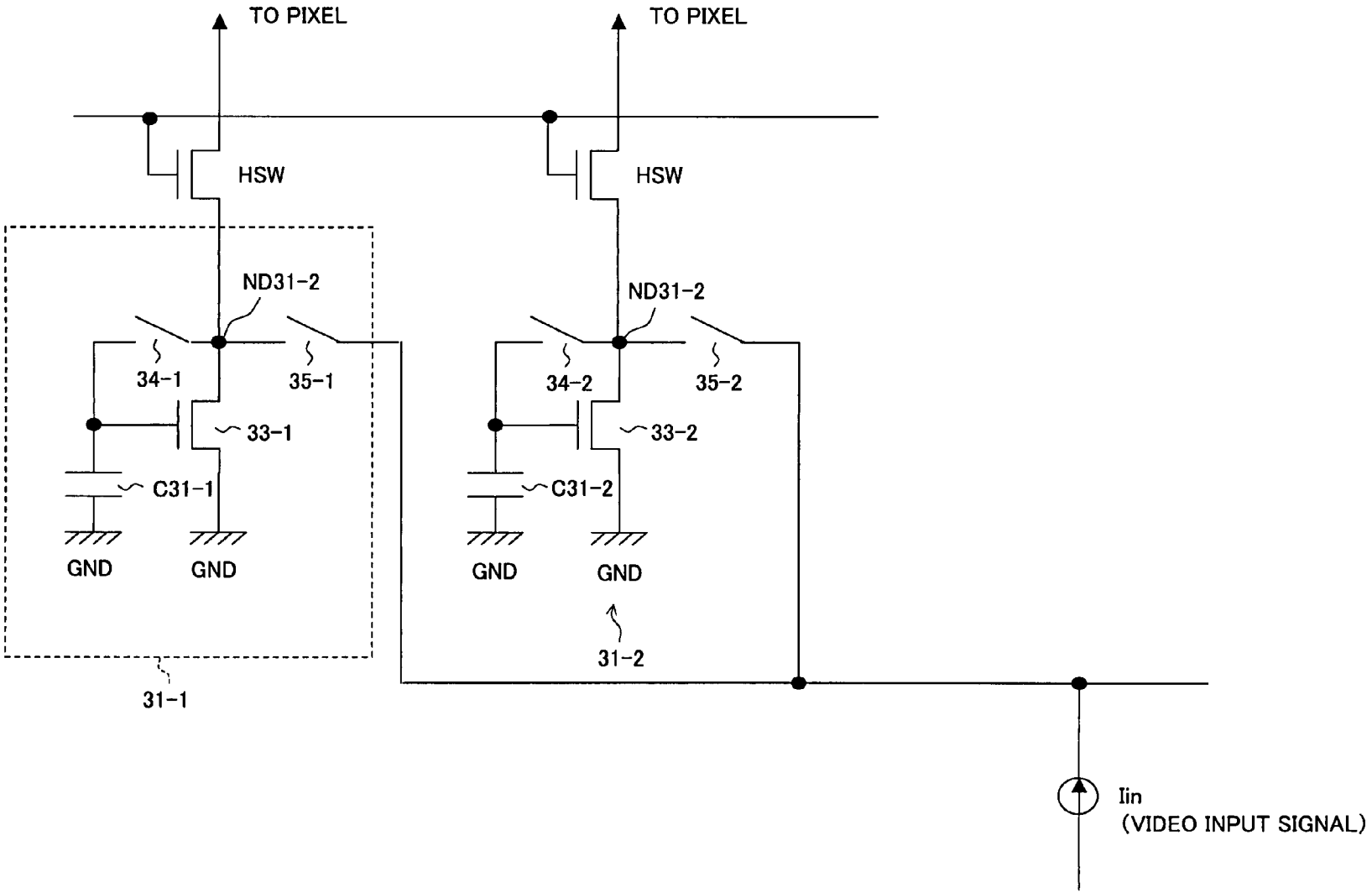
FIG. 5 is a view for explaining the operation of the circuit of FIG. 3.
Figure 6B:
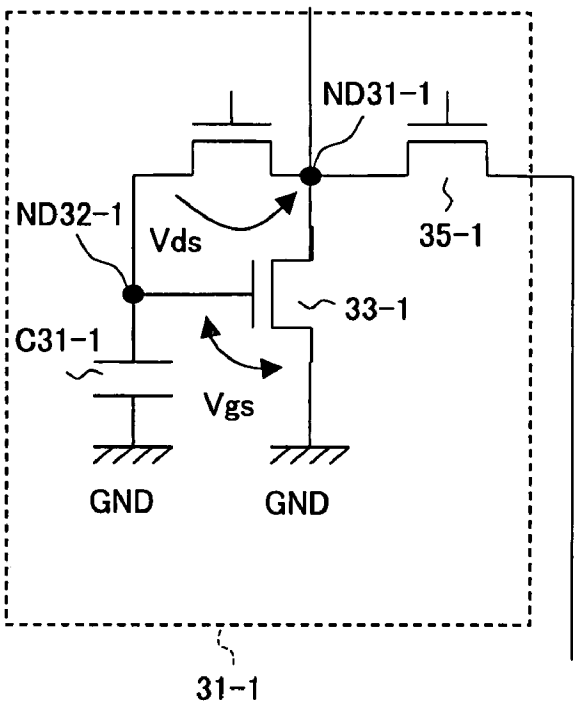
FIG. 6 is a view for explaining a problem of the circuit of FIG. 3.
Figure 6A:
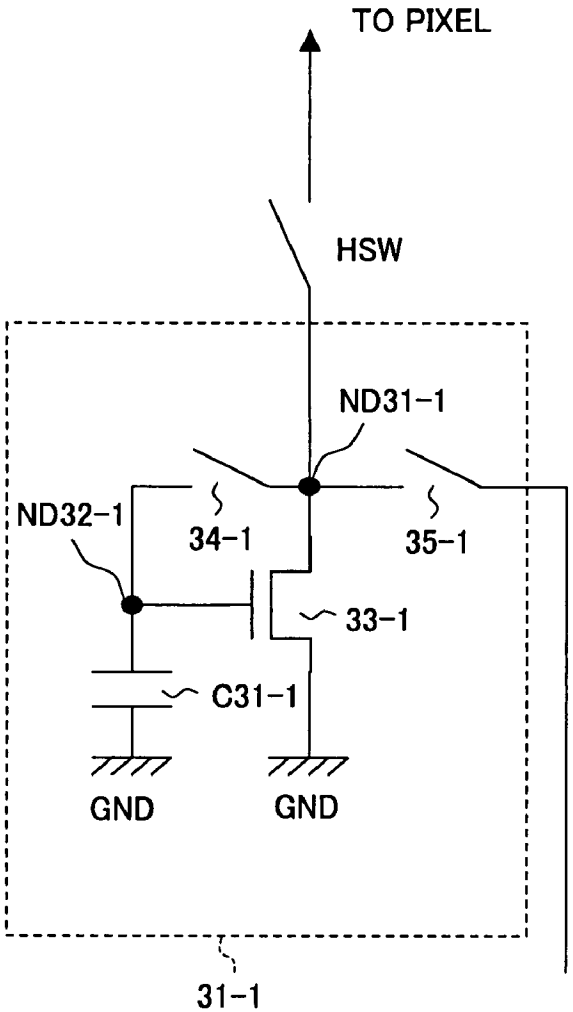
Figure 7:
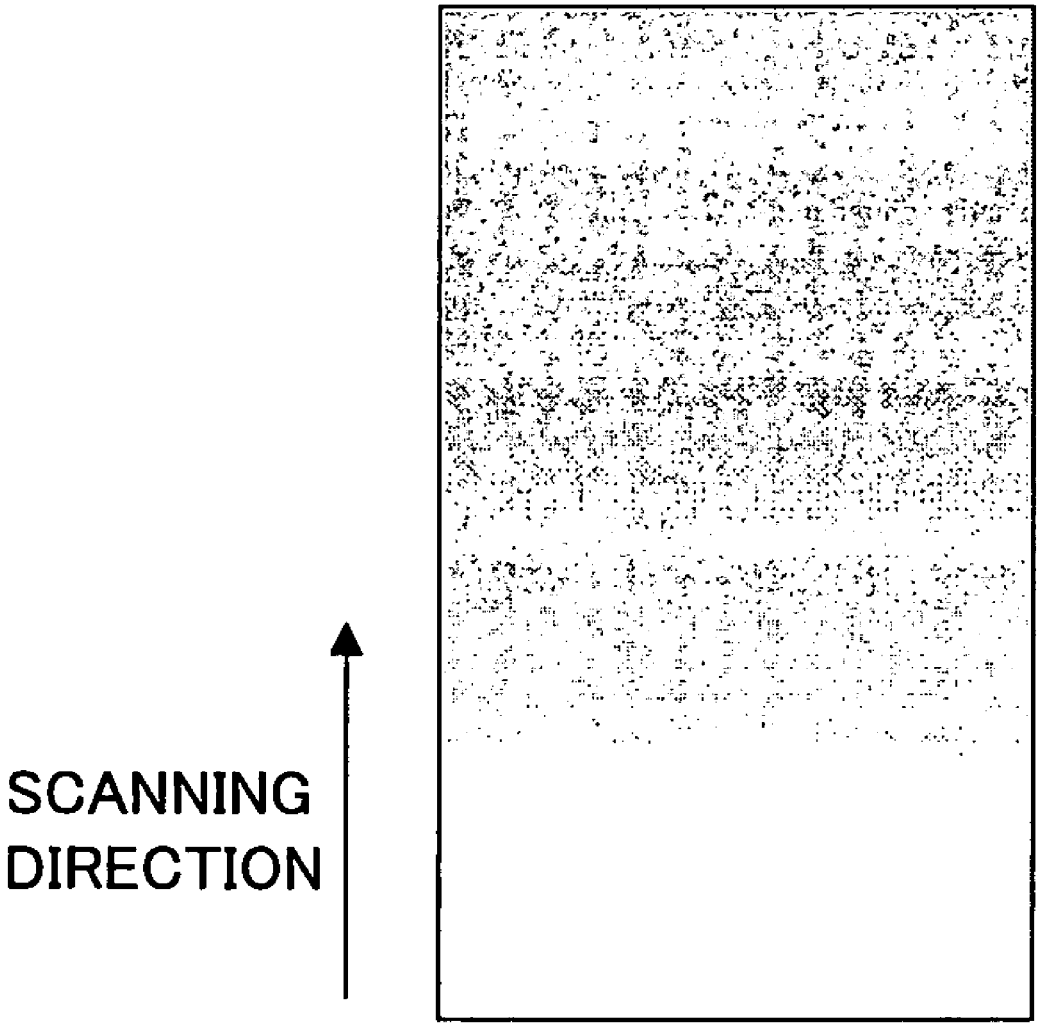
FIG. 7 is a view for explaining a problem of the circuit of FIG. 3.
Figure 8:
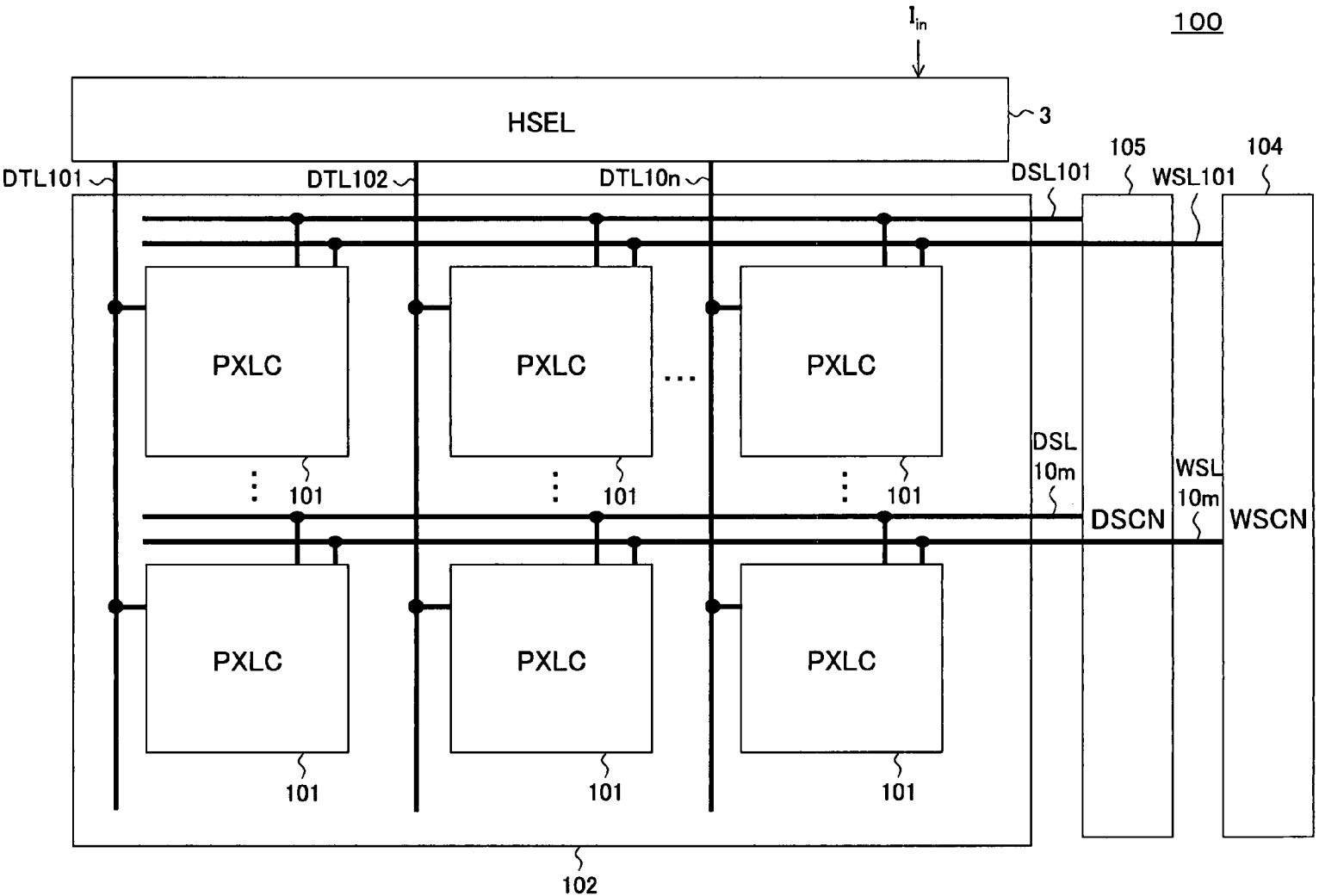
FIG. 8 is a block diagram of the configuration of an organic EL display device according to the present invention.
Figure 9:
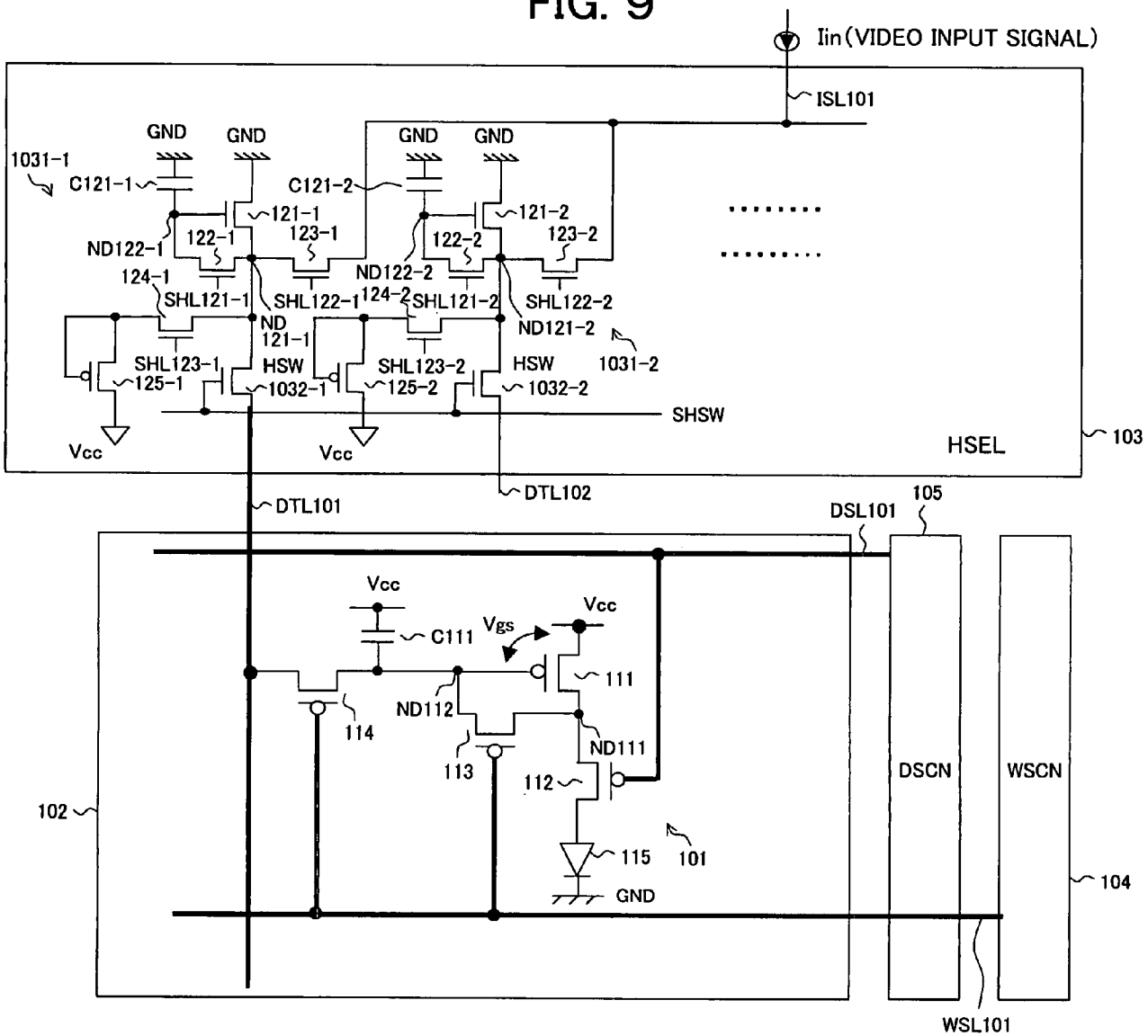
FIG. 9 is a circuit diagram of the concrete configuration of a pixel circuit according to an embodiment in the organic EL display device of FIG. 8.

FIG. 8 is a block diagram of an example of the configuration of an organic EL display device employing a current drive system according to a first embodiment. FIG. 9 is a circuit diagram of the concrete configuration of a pixel circuit and a horizontal selector according to the first embodiment in the organic EL display device of FIG. 8.

This display device 100 has, as shown in FIG. 8 and FIG. 9, a pixel array 102 comprised of pixel circuits (PXLC) 101 arrayed in an m×n matrix, a horizontal selector (HSEL) 103, a write scanner (WSCN) 104, a drive scanner (DSCN) 105, data lines DTL101 to DTL10*n* selected by the horizontal selector 103 and sequentially supplied with the data signal in accordance with the luminance information as the current signal, scanning lines WSL101 to WSL10*m* selectively driven by the write scanner 104, and drive lines DSL101 to DSL10*m* selectively driven by the drive scanner 105.

Note that, in the pixel array 102, the pixel circuits 101 are arrayed in an m×n matrix, but an example of an array of a 2×3 matrix is shown in FIG. 8 for simplification of the drawing. Further, in FIG. 9, for simplification of the drawing, only the first column and the second column current sample and hold circuits and horizontal switches HSW are described in the horizontal selector 103, but up to the n-th column current sample and hold circuits having the same configuration are arranged corresponding to the DTL101 to DTL10*n*. Further, in FIG. 9 as well, for simplification of the drawing, the concrete configuration of one pixel circuit is shown.

The pixel circuit 101 according to the first embodiment has, as shown in FIG. 9, p-channel TFTs 111 to 114, a capacitor C111, a light emitting element 115 made of an organic EL element (OLED: electro-optical element), a first node ND111, and a second node ND112. Further, in FIG. 9, DTL101 indicates a data line, WSL11 indicates a scanning line, DSL101 indicates a drive line, and SHL indicates a sample and hold line.

In the pixel circuit 101, the TFT 111, the first node ND111, the TFT 112, and the light emitting element 115 are connected in series between the power supply potential VCC and the ground potential GND. Specifically, a source of the drive transistor constituted by the TFT 111 is connected to the supply line of the power supply voltage VCC, and a drain is connected to the first node ND111. A source of the TFT 112 is connected to the first node ND111, a drain is connected to an anode of the light emitting element 115, and a cathode of the light emitting element 115 is connected to the ground potential GND. Then, a gate of the TFT 111 is connected to the second node ND112, and a gate of the TFT 112 is connected to the drive line DSL101 as the second control line. The source and the drain of the TFT 113 are connected to the first node ND111 and the second node ND112, and the gate of the TFT 113 is connected to the scanning line WSL101. A first electrode of the capacitor C111 is connected to the second node ND112, and a second electrode is connected to the power supply potential VCC. The source and the drain of the TFT 114 are connected to the data line DTL101 and the second node ND112, and a gate of the TFT 114 is connected to the scanning line WSL101.

The horizontal selector 103 has, as shown in FIG. 9, current sample and hold circuits 1031-1, 1031-2, . . . , and 1031-n and horizontal switches (HWS) 1032-1, 1032-2, . . . , and 1032-n made of n-channel TFTs provided corresponding to the data lines DTL101, DTL102, . . . , and DTL10*n* laid for every column of the matrix array of the pixel circuits and supplied with the data signal in accordance with the luminance information.

The current sample and hold circuit 31-1 has, as shown in FIG. 9, n-channel TFTs 121-1 to 124-1, a p-channel TFT 125-1, a capacitor C121-1, and nodes ND121-1 and ND122-1.

The current sample and hold circuit 1031-2 has, as shown in FIG. 9, n-channel TFTs 121-2 to 124-2, a p-channel TFT 125-2, a capacitor C121-2, and nodes ND121-2 and ND122-2. Further, although not illustrated, the current sample and hold circuit 1031-n has n-channel TFTs 121-n to 124-n, a p-channel TFT 125-n, a capacitor C121-n, and nodes ND121-n and ND122-n. The TFTs 121(-1 to -n) form field effect transistors according to the present invention, the TFTs 122(-1 to -n) form first switches, the TFTs 123(-1 to -n) form second switches, and the TFTs 125(-1 to -n) form diode connected transistors.

In the current sample and hold circuit 1031-1, a source of the TFT 121-1 is connected to the ground potential GND, a drain is connected to the node ND121-1, and a gate is connected to the node ND122-1. The source and the drain of the TFT 122-1 are connected to the node ND121-1 and the node ND122-1. A gate of the TFT 122-1 is connected to the sample and hold line SHL121-1. A first electrode of the capacitor C121-1 is connected to the node ND122-1, and a second electrode is connected to the ground potential GND. The source and the drain of the TFT 123-1 are connected to the node ND121-1 and the supply line ISL101 of the input current signal. A gate of the TFT 123-1 is connected to the sample and hold line SHL122-1. Further, a source of the TFT 125-1 is connected to the supply line of the power supply voltage VCC, and the gate and the drain of the TFT 125-1 are connected. Namely, the TFT 125-1 is diode connected. Then, the source and the drain of the TFT 124-1 are connected to the connection point of the gate and drain of the TFT 125-1 and the node ND121-1, and the gate of the TFT 124-1 is connected to the sample and hold line SHL123-1. Further, the node ND121-1 is connected to the horizontal switch 1032-1.

The leakage elimination circuit according to the present invention is configured by the TFT 124-1 and the TFT 125-1.

Note that the other current sample and hold circuits 1031-2 to 1031-n are connected in the same way as the above current sample and hold circuit 1031-1, so details will be omitted here.

Next, the operation of the above configuration will be explained in relation to FIGS. 10A to 10O focusing on the operation of the horizontal selector.

Figure 10:
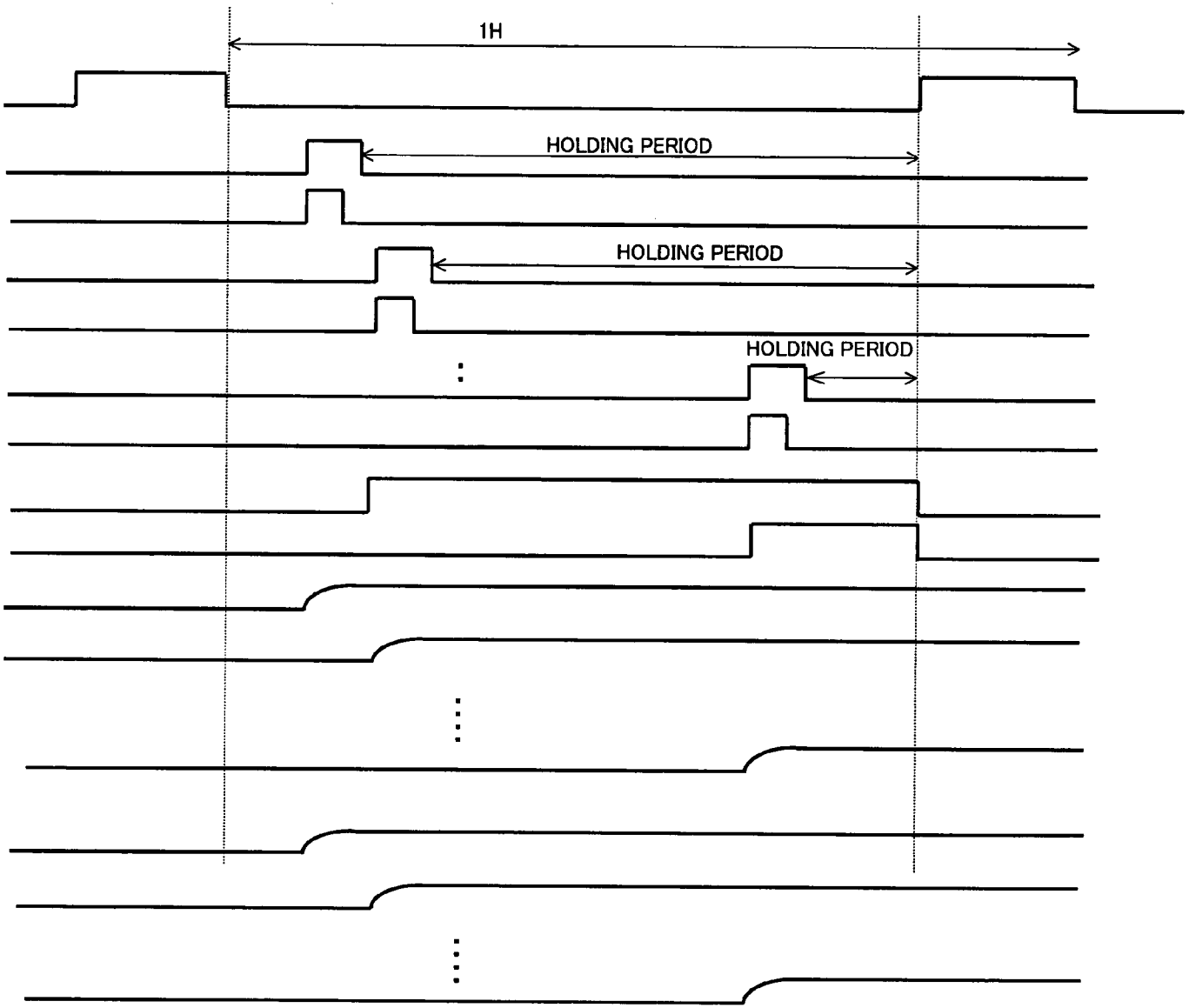
FIGS. 10A to 10O are timing charts for explaining an operation according to a first embodiment.

Note that, SHSW of FIG. 10A shows the switch signal of the horizontal switch. Further, FIG. 10J shows a drain potential Vd1211 of the first column TFT 121-1, FIG. 10K shows a drain potential Vdl212 of the second column TFT 121-2, and FIG. 10L shows a drain potential Vdl2*ln* of the n-th column TFT 121-n, FIG. 10M shows a potential VC1211 of the first column capacitor C121-1, FIG. 10N shows a potential VC1212 of the second column capacitor C121-2, and FIG. 10O shows a potential VC121*n* of the n-th column capacitor C121-n.

As shown in FIG. 10A, in a state where the switch signal SHSW is at the low level and all of the horizontal switches HSW are turned off, as shown in FIGS. 10B and 10C, the TFTs 122-1 and 123-1 are placed in the conductive state (turned on) by making the sample and hold lines SHLs 121-1 and 122-1 to which the TFTs 122-1 and 123-1 of the first column current sample and hold circuit 1031-1 are connected the high level. At this time, the input signal current Iin flows in the current sample and hold circuit 1031-1. At this time, the TFT 121-1 is connected at the gate and the drain via the TFT 122-1 and operates in the saturation region. The gate voltage thereof is determined based on the above equation 1 and, as shown in FIG. 10M, is held in the capacitor C121-1. After the predetermined gate voltage is written into the capacitor C121-1, the TFT 122-1 is placed in the nonconductive state by making the sample and hold line SHL121-1 the low level, then the TFT123-1 is placed in the nonconductive state by making the sample and hold line SHL122-1 the low level.

Next, in the same way as above, as shown in FIGS. 10D and 10E, the sample and hold lines SHL 121-2 and 122-2 to which the TFTs 122-2 and 123-2 of the second column current sample and hold circuit 1031-2 are connected are made the high level to place the TFTs 122-2 and 123-2 in the conductive state (turned on). At this time, the input signal current Iin flows in the current sample and hold circuit 1031-2. At this time, the TFT 121-2 is connected at the gate and the drain via the TFT 122-2 and operates in the saturation region. The gate voltage thereof is determined based on the above equation 1 and, as shown in FIG. 10N, is held in the capacitor C121-2. After the predetermined gate voltage is written into the capacitor C121-2, the TFT 122-2 is placed in the nonconductive state by making the sample and hold line SHL121-2 the low level, then the TFT123-2 is placed in the nonconductive state by making the sample and hold line SHL122-2 the low level.

Below, adjacent sample and hold circuits sequentially operate, whereby the video signal Iin is point sequentially sampled and held in all circuits.

In the present embodiment, during the period where the sampling and holding operation of the same stage is terminated and the other stage is performing the sampling and holding operation, for example, the current sample and hold circuit 1031-1 finishing sampling and holding makes the sample and hold line SHL123-1 the high level and makes the TFT 124-1 the conductive state as shown in FIG. 10H. Then, in the TFT 125-1, the gate and the drain are connected, so a current according to the constant current source TFT 121-1 flows. Here, the input current Iin is sampled and held in the constant current source TFT 121-1, therefore the current Iin flows in the TFT 125-1 and TFT 121-1.

Figure 11:
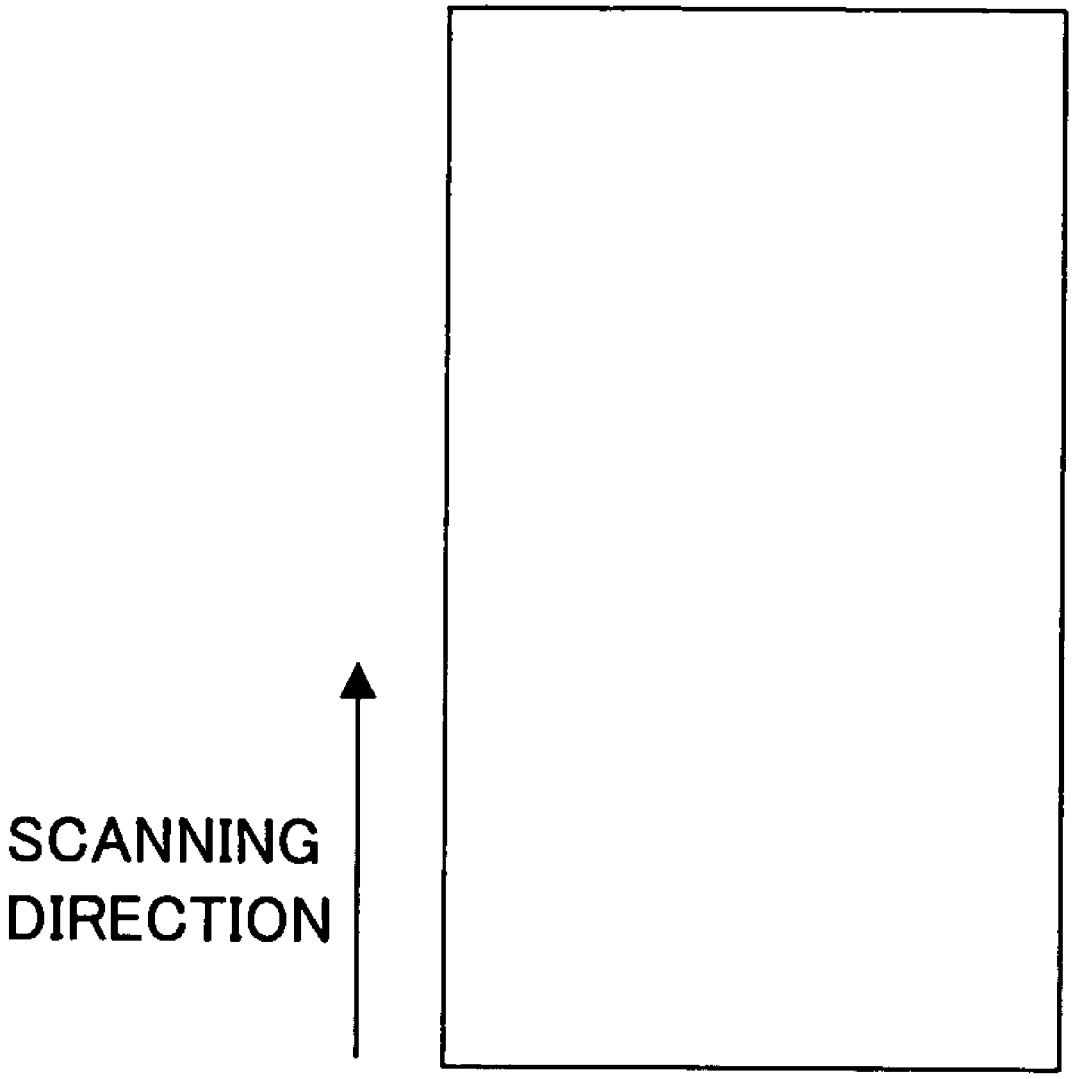
FIG. 11 is a diagram for explaining the advantages of the first embodiment.

Consider next the drain voltage of the TFT 121-1 at this time constituted by the potential of the node ND121-1. As mentioned above, the constant current corresponding to the sampled current Iin flows in the TFT 125-1. The TFT 125-1 operates in the saturation region, so the operation point of the gate voltage (drain voltage) of the TFT 125-1 is determined based on equation 1. This gate potential becomes equal to the potential of the node ND121. Here, by designing the size of the TFT 125-1 so that the potential of the node ND121 becomes equal to the ate voltage of the TFT 121-1 as much as possible (note, the TFT 121-1 is driven in the saturation region), the voltage difference between the source and the drain of the TFT 122-1 can be suppressed. If this voltage difference is small, the leakage amount of the TFT 122-1 can be greatly suppressed. As shown in FIGS. 10M to 10O, the fall of the gate voltage of the TFT 121-1 due to leakage can be suppressed. From the above description, in the point sequential sampling of the current, it is possible to make the leakage amount almost no different between the scanning start and end part blocks, and a uniform output current can be obtained. Thereafter, as shown in FIG. 10A, all stages of the horizontal switch HSW are simultaneously turned on, the TFT 121-1 to TFT 121-n act as constant current sources, and the sampled and held current values are output to the data lines DTL101 to DTL10*n*. Due to this, as shown in FIG. 11, it becomes possible to display a high quality image free from occurrence of uneven luminance toward the scanning end part.

Further, in the pixel circuit 101, at the time of the writing the input signal (current signal) SI, in a state where the drive line DSL101 is placed at the high level and the TFT 112 is held in the nonconductive state, the scanning line WSL101 is placed at the low level, and the TFT 113 and TFT 114 are held in the conductive state. Due to this, a current in accordance with the signal current flows through the drive transistor constituted by the TFT 111. At this time, the TFT 111 is electrically connected at the gate and the drain by the TFT 113 in the conductive state, and the TFT 111 is driven in the saturation region. Accordingly, a gate voltage corresponding to the input current is written based on the above equation 1 and held in the pixel capacitance constituted by the capacitor C111. Thereafter, the TFT 114 is held in the nonconductive state, and the TFT 112 is held in the conductive state. Due to this, a current in accordance with the input signal current flows in the TFT 112 and the light emitting element 115, and the light emitting element 115 emits light with a luminance in accordance with the current value thereof.

According to the first embodiment, in the period where the sampling and holding operation of the same stage are terminated and another stage is performing the sampling and holding operation, for example, the current sample and hold circuit 1031-1 finishing the sampling and holding is configured so as to carry the constant current corresponding to the current Iin sampled by the TFT 125-1 through the node ND121-1 by operating the leakage elimination circuit. Therefore, in the sampling period of the other circuit as well, the drain potential of the output transistor TFT 121 functioning as a constant current source can be held constant, and it becomes possible to suppress the change due to the leakage of the gate potential of the output transistor. As a result, a uniform current source free from variation of the current value of the output stage can be obtained, and a high quality image without occurrence of uneven luminance toward the scanning end part can be displayed.

Second Embodiment

Figure 12:
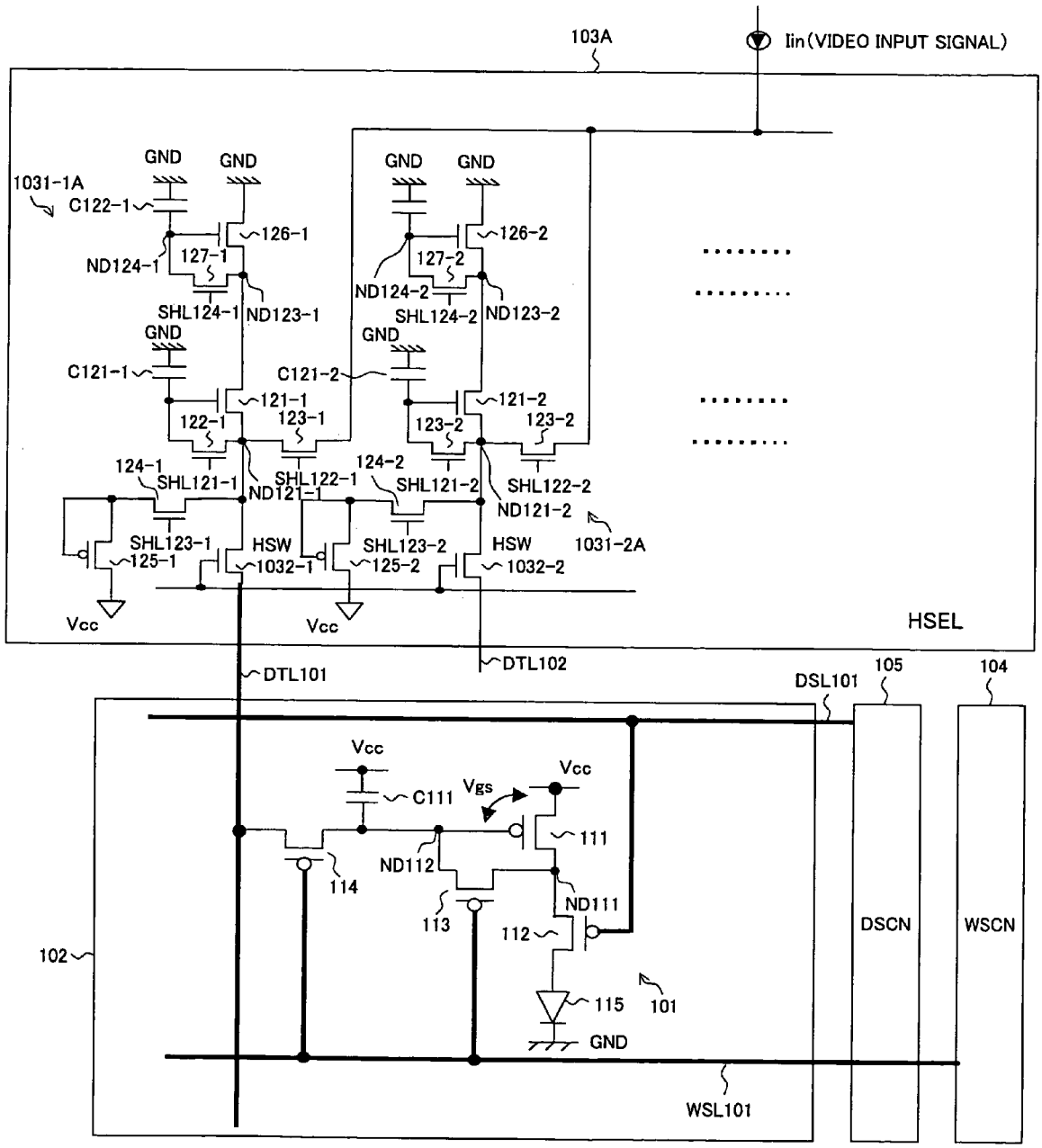
FIG. 12 is a block diagram of an example of the configuration of an organic EL display device employing a current drive system according to a second embodiment.

FIG. 12 is a block diagram of an example of the configuration of an organic EL display device employing the current drive system according to a second embodiment.

The difference of the second embodiment from the above first embodiment resides in that further a constant current source circuit comprised of n-channel TFTs 126 and 127 and a capacitor C122 is cascade connected (second stage serial connected) to the constant current source circuit comprising the TFTs 121 and 122 and the capacitor C121 between the node ND121 and the ground potential GND.

Here, this will be explained by taking a current sample and hold circuit 1031-1A as an example. The other current sample and hold circuits 1031-2A to 1031-nA have the same configuration as the current sample and hold circuit 1031-1A, so the explanation is omitted here.

In the current sample and hold circuit 1031-1A, the source of the second field effect transistor constituted by the TFT 121-1 is connected to the node ND123-1 in place of the ground potential GND, a drain of the first field effect transistor constituted by the TFT 126-1 is connected to the node ND123-1, and a source of the TFT 126-1 is connected to the ground potential GND. A gate of the TFT 126-1 is connected to the node ND124-1. Then, the source and drain of the third switch constituted by the TFT 127-1 are connected to the node ND123-1 and the node ND124-1, and a gate of the TFT 127-1 is connected to the sample and hold line SHL124-1. A first electrode of the second capacitor C122-1 is connected to the node ND124-1, and the second electrode is connected to the ground potential GND. In the second embodiment, the TFTs 124(-1 to -n) configure fourth switches of the present invention.

In the current sample and hold circuit 1031-A of FIG. 12, the sample and hold lines SHL121-1, SHL122-1, and SHL127-1 are set at the high level to place the TFTs 122-1, 123-1, and 127-1 in the conductive state. Along with the TFT 123-1 becoming the conductive state, the signal current Iin flows in the current sample and hold circuit 1031-A. At this time, the TFT 121-1 is connected at the gate and drain via the TFT 122-1 and operates in the saturation region. The gate voltage thereof is determined based on the above equation 1 and held in the capacitor C121-1. In the same way as above, the current is supplied via the TFT 121-1 to the node ND123-1. At this time, the TFT 126-1 operates in the saturation region via the TFT 127-1. The gate voltage thereof is determined based on the above equation 1 and is held in the capacitor C122-1. After the predetermined gate voltage is written into the capacitors C121-1 and C122-1 in this way, the TFT 127-1 is placed in the nonconductive state by setting the sample and hold line SHL127-1 at the low level. Next, after placing the TFT 122-1 at the nonconductive state by setting the sample and hold line SHL122-1 at the low level, the TFT 123-1 is placed in the nonconductive state by setting the sample and hold line SHL123-1 at the low level. Then, after the TFT 123-1 is placed in the nonconductive state, the sample and hold line SHL123-1 is placed in the high level, and the TFT 124-1 is placed in the conductive state. The current Iin flows in this circuit, but the gate voltage (drain voltage) of the TFT 125-1 becomes a voltage corresponding to the current Iin. In this case, the TFT 125-1 is designed in size so that the TFT 121-1 and the TFT 126-1 can be driven in the saturation region.

Figure 13:
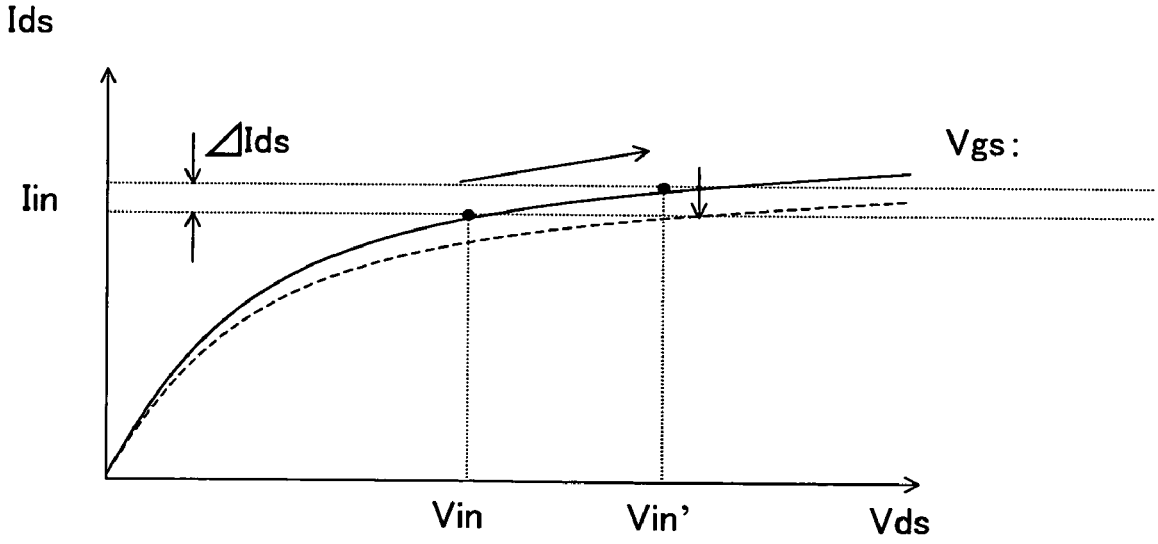
FIG. 13 is a view for explaining the operation of the second embodiment.

Here, consider the operation point of the TFT 121-1. When the TFT 124-1 becomes the conductive state, the drain voltage (B) of the TFT 121-1 becomes equal to the drain voltage of the TFT 125-1. As shown in FIG. 13, the source-drain voltage Vds of the TFT 121-1 increases (Vin→Vin'), and the current value passed increases by exactly the early effect, that is, ΔIds. However, the constant current source including the TFT 126-1 is continuously carrying the current Iin. Therefore, the source voltage of the TFT 121-1 increases in order to obtain a current value corresponding to the current Iin. However, the change of the current value due to the change of the source voltage of the TFT 121-1 becomes effective as the square according to equation 1, so this source potential does not change much at all. In FIG. 13, a drain voltage (Vd)—drain current (Id) curve of the TFT 121-1 after this change is indicated by a broken line.

Here, the source potential of the TFT 121-1 is the same potential as the drain potential (A) of the TFT 126-1. Accordingly, when cascade connected, the drain voltage of the TFT 126-1 has a value when writing the current Iin, that is, almost an equal value to the gate voltage of the TFT 126-1. Due to this, the source-drain voltage of the TFT 127-1 becomes almost 0V, and the drop of the gate voltage of the TFT 126-1 due to the leakage current can be greatly suppressed.

From the above description, in the shading at the organic EL etc. or the current point sequential sample and hold circuit, as in the present embodiment, a current output without variation is obtained without designing the operation point and size of the transistor. Note that, in the present system, the transistor 125(-1 to -n) of the leakage elimination circuit is configured as a p-channel, but n-channel transistors may also be diode connected.

Figure 14:
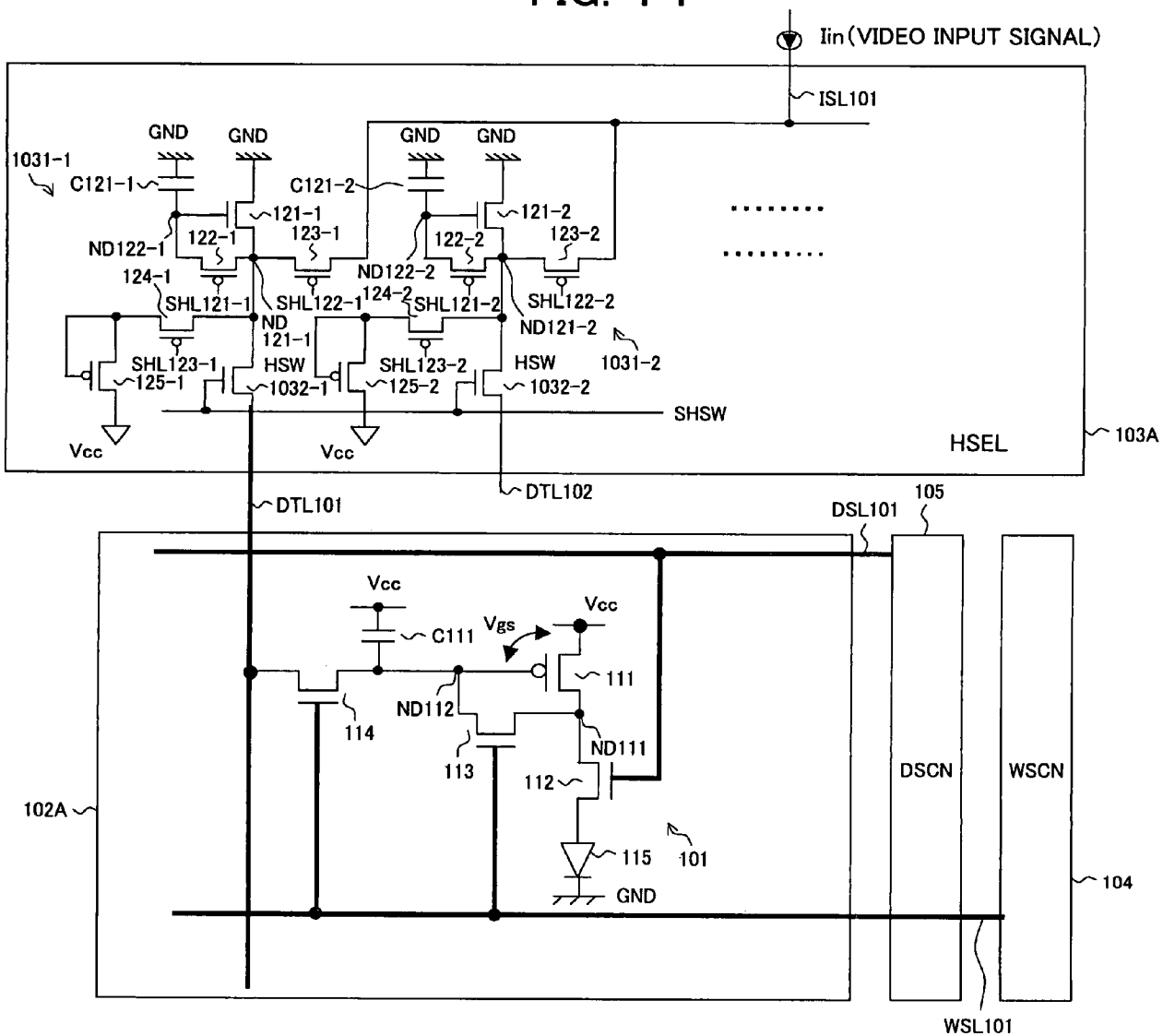
FIG. 14 is a circuit diagram of another example of the configuration of the pixel circuit and a current sample and hold circuit.

In the above embodiments, TFTs configuring the pixel circuit 102 were all configured as p-channel types, but the TFTs 112, 113, and 114 functioning as the other switches of the drive transistor constituted by the TFT 111 may be n-channel TFTs or CMOS' too as shown in FIG. 14. Further, in the above embodiments, the TFTs 122(-1 to -n) to 124(-1 to -n) functioning as the switches of the current sample and hold circuits 1031-1 to 1031-n of the horizontal selector 103 may be p-channel TFTs too as shown in FIG. 14.

Figure 15:
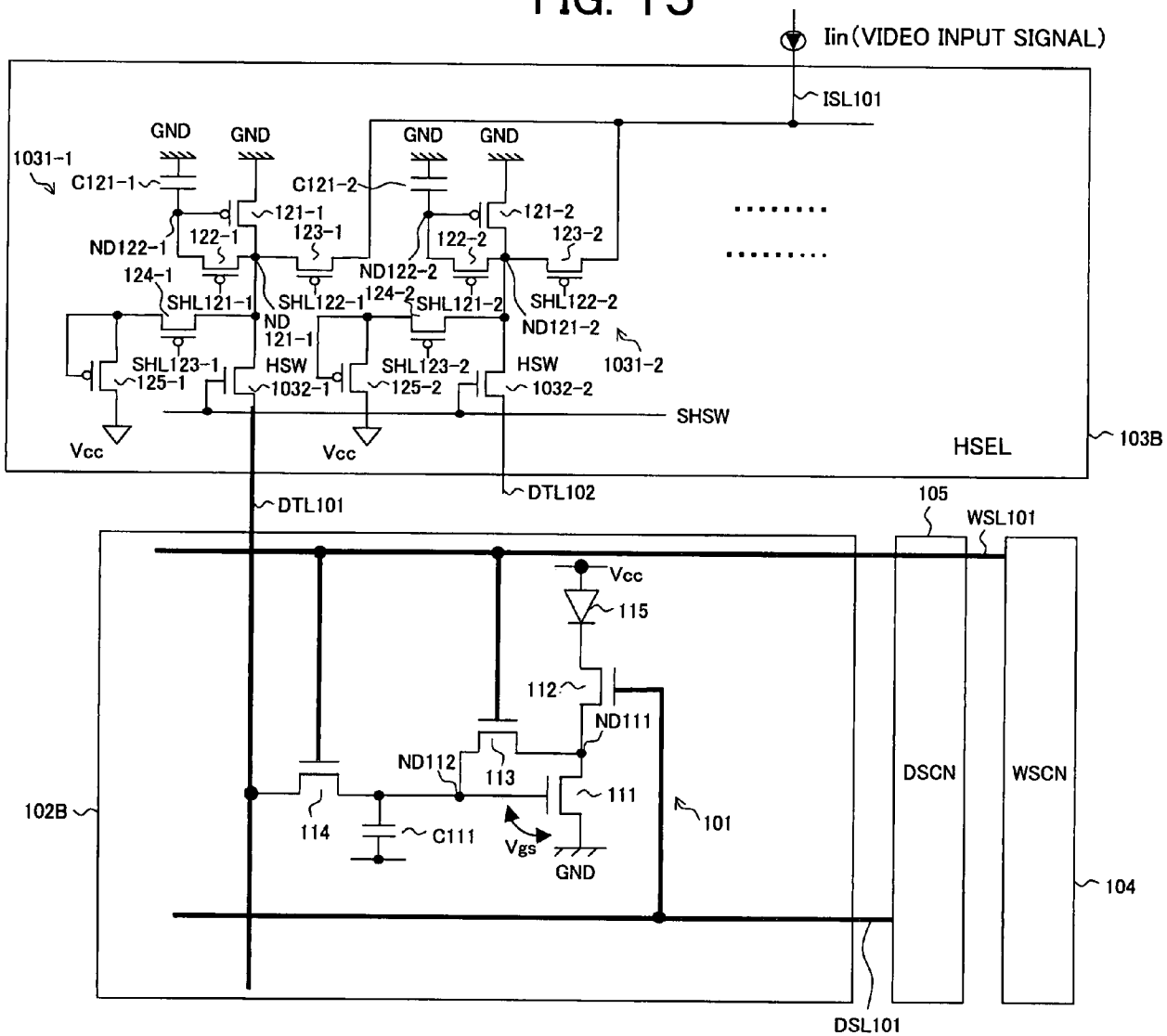
FIG. 15 is a circuit diagram of still another example of the configuration of the pixel circuit and the current sample and hold circuit.

Further, in the above embodiments, the TFTs configuring the pixel circuit 102 were all configured as p-channel transistors, but it is also possible to configure the TFT 111 functioning as the drive transistor and the TFTs 112, 113, and 114 functioning as the switches by n-channel TFTs as shown in FIG. 15. Of course, the connection with the EL light emitting element 115 may be an anode connection or a cathode connection too. In this case, the drive transistors of the current sample and hold circuits 1031-1 to 1031-n must be p-channel types as shown in FIG. 15.

Summarizing the effects of the invention, as explained above, according to the present invention, in the sampling period of another circuit as well, the drain potential of an output transistor functioning as a constant current source can be held constant, and a change due to leakage of the gate potential of the output transistor can be suppressed. By eliminating the leakage during the holding period, variation of the output current values due to the hold time difference can be suppressed and a uniform constant current source can be formed. Further, by using a cascade connection in the sample and hold circuit, this variation can be almost completely suppressed. The above effect of the suppression of variation is conspicuous in a TFT having a large leakage current. For this reason, an image quality having a high uniformity can be obtained in a current driven organic EL display using TFTs.

While the invention has been described with reference to specific embodiments chosen for purpose of illustration, it should be apparent that numerous modifications could be made thereto by those skilled in the art without departing from the basic concept and scope of the invention.

What is claimed is:

1. A display device to which a video signal is supplied as a signal current, comprising:

a plurality of pixel circuits arrayed in a matrix;

data lines laid for every column of the matrix array of said pixel circuits and supplied with a signal current in accordance with luminance information; and a horizontal selector having a plurality of sample and hold circuits provided corresponding to said data lines and sampling and holding the input video signal current and for sequentially operating the sample and hold circuits, point sequentially sampling and holding video signals at all sample and hold circuits, and outputting current values sampled and held in said plurality of sample and hold circuits to corresponding data lines, wherein each sample and hold circuit comprises:

a field effect transistor having a source connected to a predetermined potential, a first switch connected between a drain and a gate of said field effect transistor, a second switch connected between the drain of said field effect transistor and a supply line of said signal current, a capacitor connected between the gate of said field effect transistor and a predetermined potential, and a leakage elimination circuit for supplying a current corresponding to the sampled signal current to the drain of said field effect transistor during a period when the sample and hold operation is finished and another sample and hold circuit performs a sample and hold operation.

2. A display device as set forth in claim 1, wherein said leakage elimination circuit comprises a diode connected transistor connected between a predetermined potential and the drain of said field effect transistor and a third switch connected in series.

3. A display device to which a video signal is supplied as a signal current, comprising:

a plurality of pixel circuits arrayed in a matrix;

data lines laid for every column of the matrix array of said pixel circuits and supplied with a signal current in accordance with luminance information; and a horizontal selector having a plurality of sample and hold circuits provided corresponding to said data lines and sampling and holding the input video signal current and for sequentially operating the sample and hold circuits, point sequentially sampling and holding a video signal in all sample and hold circuits, and outputting current values sampled and held at said plurality of sample and hold circuits to corresponding data lines, wherein each sample and hold circuit comprises a first field effect transistor having a source connected to a predetermined potential, a second field effect transistor having a source connected to a drain of said first field effect transistor, a first switch connected between a drain and a gate of said second field effect transistor, a second switch connected between the drain of said second field effect transistor and a supply line of said signal current, a third switch connected between the drain and a gate of said first field effect transistor, a first capacitor connected between the gate of said first field effect transistor and a predetermined potential, a second capacitor connected between the gate of said second field effect transistor and a predetermined potential, and a leakage elimination circuit for supplying a current corresponding to the sampled signal current to the drain of said second field effect transistor during a period when the sample and hold operation is finished and another sample and hold circuit is performing a sample and hold operation.

4. A display device as set forth in claim 3, wherein said leakage elimination circuit comprises a diode connected transistor connected between a predetermined potential and the drain of said second field effect transistor and a fourth switch connected in series.

* * * * *